US008413706B2

(12) United States Patent
Kotin

(10) Patent No.: US 8,413,706 B2
(45) Date of Patent: Apr. 9, 2013

(54) WINDOW COVERING FOR AN ARCHITECTURAL OPENING

(75) Inventor: Jay S. Kotin, Irvine, CA (US)

(73) Assignee: Gracious Living Innovations, Inc., Ontario (CA)

( * ) Notice: Subject to any disclaimer, the term of this patent is extended or adjusted under 35 U.S.C. 154(b) by 255 days.

(21) Appl. No.: 12/925,006

(22) Filed: Oct. 12, 2010

(65) Prior Publication Data

US 2012/0085031 A1 Apr. 12, 2012

(51) Int. Cl.
*E06B 9/00* (2006.01)

(52) U.S. Cl. ..... 160/236

(58) Field of Classification Search ..... 160/168.1 R, 160/236, 166.1, 167 R, 167 V, 174 R, 174 V, 160/130, 178.1 R, 178.1 V, 235; 49/92.1
See application file for complete search history.

(56) References Cited

U.S. PATENT DOCUMENTS

| | | | | |
|---|---|---|---|---|
| 1,949,653 | A * | 3/1934 | Hubert | 160/170 |
| 2,121,217 | A | 1/1937 | Ellis | |
| 2,155,985 | A | 6/1937 | Waterman | |
| 2,209,355 | A | 3/1939 | Schmitz | |
| D152,818 | S * | 2/1949 | Nelson | D6/580 |
| 3,198,298 | A * | 8/1965 | Ferris | 49/91.1 |
| 3,916,973 | A * | 11/1975 | Schuppler et al. | 160/178.3 |
| 4,236,566 | A | 12/1980 | Hensel | |
| 4,343,171 | A * | 8/1982 | Kagawa | 72/181 |
| 4,436,136 | A * | 3/1984 | Downey, Jr. | 160/232 |
| 4,450,701 | A * | 5/1984 | Treiber et al. | 72/181 |
| 4,799,526 | A * | 1/1989 | Reeves | 160/168.1 R |
| 5,095,965 | A * | 3/1992 | Higashiyama | 160/133 |
| 5,358,024 | A * | 10/1994 | Schwaegerle | 160/236 |
| 5,423,367 | A * | 6/1995 | Kataoka et al. | 160/168.1 R |
| 5,657,806 | A | 8/1997 | Hung | |
| 5,845,694 | A * | 12/1998 | Cohen | 160/168.1 R |
| 5,957,183 | A | 9/1999 | Prince | |
| 6,192,964 | B1 * | 2/2001 | Cianci et al. | 160/173 R |
| 6,219,985 | B1 * | 4/2001 | Hsu | 52/473 |
| 6,371,193 | B1 | 4/2002 | Goodman | |
| 6,619,367 | B1 * | 9/2003 | Kawakita | 160/178.1 R |
| 6,675,859 | B2 * | 1/2004 | Nien | 160/89 |
| D495,549 | S * | 9/2004 | Yu et al. | D6/577 |
| 7,503,371 | B2 * | 3/2009 | Lee | 160/236 |
| 8,082,693 | B2 * | 12/2011 | Marocco | 49/74.1 |
| D660,461 | S * | 5/2012 | Kotin et al. | D25/119 |
| D660,984 | S * | 5/2012 | Kotin et al. | D25/119 |
| 2003/0205339 | A1 * | 11/2003 | Colson et al. | 160/236 |
| 2005/0230063 | A1 | 10/2005 | Hwang | |
| 2008/0093036 | A1 | 4/2008 | Lin | |
| 2008/0245488 | A1 * | 10/2008 | Colson et al. | 160/168.1 R |
| 2008/0314532 | A1 * | 12/2008 | Chen | 160/236 |

(Continued)

FOREIGN PATENT DOCUMENTS

| | | | |
|---|---|---|---|
| CH | 618496 | A * | 7/1980 |
| EP | 268573 | A2 * | 5/1988 |

*Primary Examiner* — Katherine Mitchell
*Assistant Examiner* — Johnnie A Shablack
(74) *Attorney, Agent, or Firm* — Leonard Tachner

(57) ABSTRACT

A window covering louvered blind system for horizontal and vertical orientations has a plurality of structurally sound and aesthetically appealing louvers within the body of the window-covering unit. A primary main body or middle segment of the louver is substantially planar with opposed fins that extend integrally in the same downward direction from the elongated edges of the main body at an obtuse angle. The preferred embodiments have a matching head-rail and bottom rail. Both symmetrical and asymmetrical versions of fins are disclosed. The louvers hereof are shown being used in blinds and shutters.

20 Claims, 11 Drawing Sheets

U.S. PATENT DOCUMENTS

2009/0242144 A1* 10/2009 Yu et al. ..... 160/176.1 R
2010/0163191 A1* 7/2010 Homery ..... 160/236
2010/0263804 A1* 10/2010 Shprung ..... 160/133
2011/0277944 A1* 11/2011 Chen ..... 160/236

* cited by examiner

WINDOW COVERING FOR AN ARCHITECTURAL OPENING

BACKGROUND OF THE INVENTION

1. Field of the Invention

This invention relates to an improved vane system for use in horizontal Venetian blinds and shutters and vertical blinds and shutters, which may be used to cover an architectural opening in a building.

2. Background Art

Window blinds have been used for centuries to cover and to provide light control in buildings. Horizontal, or Venetian blinds and shutters, as well as vertical blinds are commonly comprised of a plurality of flat, coved, or S-shaped wood, plastic, fabric or metal vanes or louvers that hang from hardware, which enables the vanes to be tilted to control light.

Venetian blind systems include an upper head-rail control unit that is installed into or over an architectural opening. Suspended down from this unit are at least two lift cords as well as at least 2 ladder-like configurations that hold the vanes or louvers a predetermined distance from each other in parallel. The lift cords are attached at the bottom of the unit to a bottom rail, which hangs within the ladders below the last louver. Pulling on the lift cords raises the blind, and the blind may be locked into position by means of a cord lock that the cords pass through, which is located within the head-rail. The louvers may also be tilted to control light by means of a tilting mechanism, which is suspended from the head-rail.

U.S. patents showing shaped vanes for blinds, include the following:

U.S. Pat. No. 2,121,217
U.S. Pat. No. 2,155,985
U.S. Pat. No. 2,209,355
U.S. Pat. No. 3,916,973
U.S. Pat. No. 4,236,566
U.S. Pat. No. 5,657,806
U.S. Pat. No. 5,957,183
U.S. Pat. No. 6,371,193
U.S. Pat. No. D495,549 and published applications 2005/0230063 and 2008/0093036 also show vane shapes.

SUMMARY OF THE INVENTION

The present invention comprises a set of blinds wherein each vane or louver is uniquely configured to have a cross-section which provides better resistance to bending, enabling the vane to traverse a greater span without bow and camber and better light control than conventional vanes or louvers. Two distinct preferred embodiments are disclosed herein. Each such embodiment employs a vane having a cross-section providing a planar middle section and opposed fins extending downward integrally from opposite edges of the middle section in a direction which forms an obtuse angle relative to the middle section. In one such embodiment, the fins are identical to one another to form a symmetrical vane cross-section. In another such embodiment the fins are different from each other to form an asymmetrical cross-section. In the disclosed asymmetrical embodiment, the fins are of different length. Moreover, in each embodiment the fins are tapered along at least a portion of their length. In addition, the fins are curved along at least a portion of their length.

It has been found that the combination of a planar middle section extending integrally into opposed curved and tapered fins, results in vanes which are more resistant to bending, having better deflection properties which results in better control and which provides unique and advantageous aesthetic effects. It has also been found that the use of a head-rail and a bottom rail that are each shaped to have a predominant surface characteristic that replicates the face of the vane cross-section, is also advantageous aesthetically and for efficient nesting.

As used herein the term vanes, slats and louvers are interchangeable and refer to the individual elements of blinds and shutters that control the level of light that may pass or be blocked by a window covering unit. Such elements may be either vertical or horizontal so that each such term should be deemed to include both vertical and horizontal blinds as well as vertical and horizontal shutters.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 7:
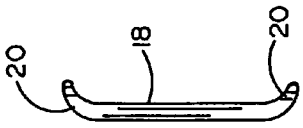
FIG. 7 is a left side view of the vane of FIG. 2.
Figure 8:
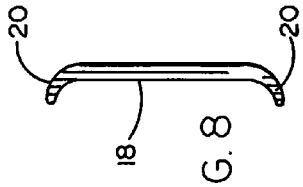
FIG. 8 is a right side view of the vane of FIG. 2.
Figure 9:
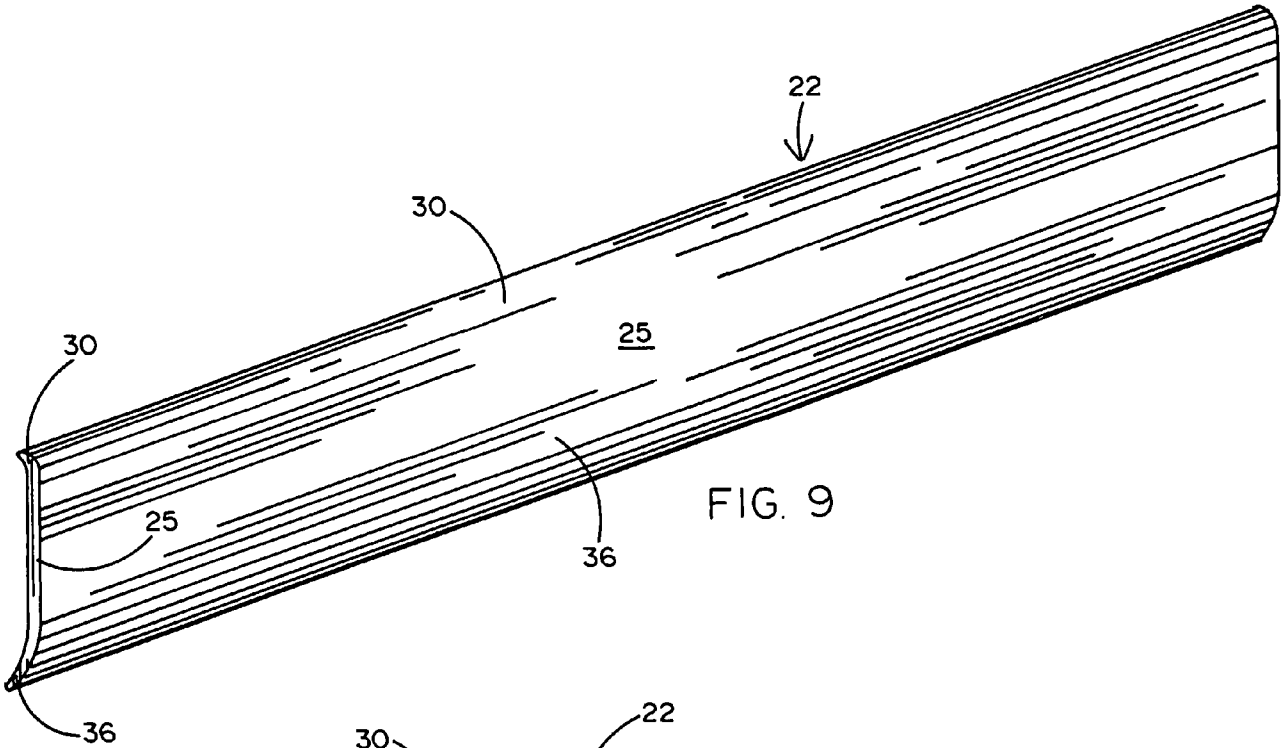
FIG. 9 is a three-dimensional view of an asymmetrical version of a vane for use in the set of blinds of FIG. 1.
Figure 10:
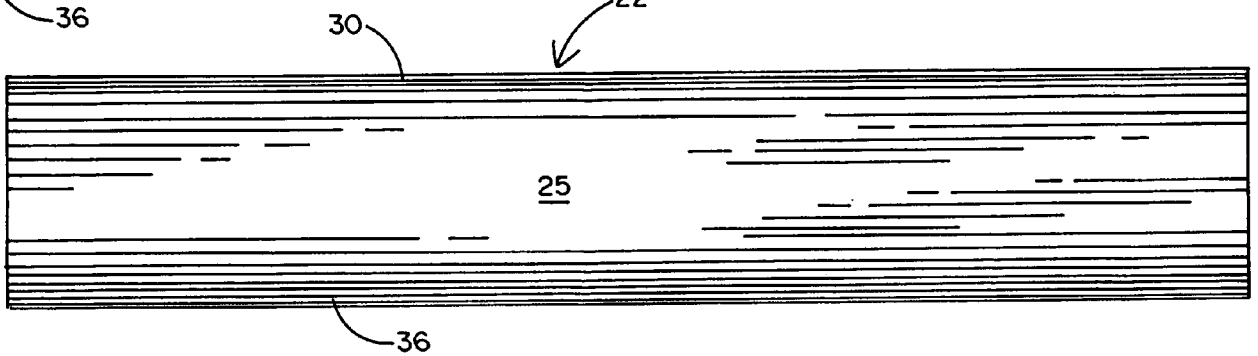
FIG. 10 is a front plan view of the vane of FIG. 9.
Figure 11:
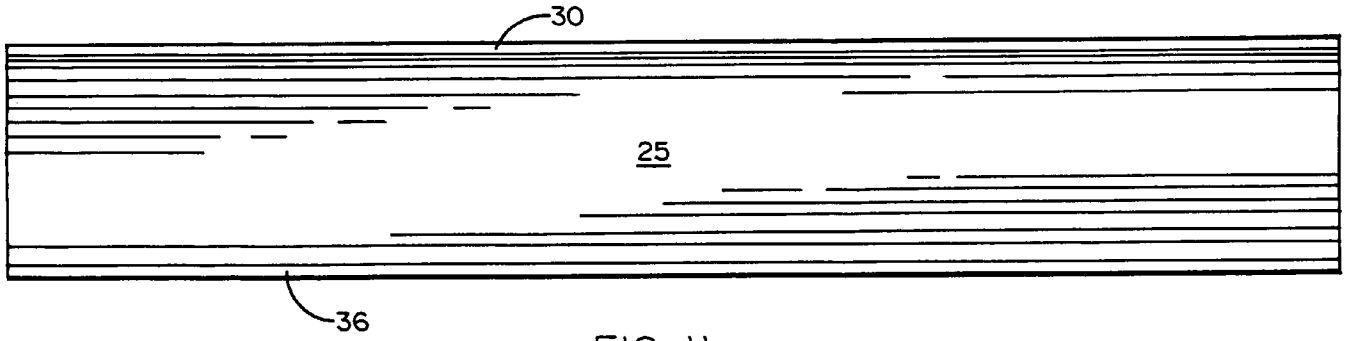
FIG. 11 is a rear plan view of the vane of FIG. 9.
Figure 12:
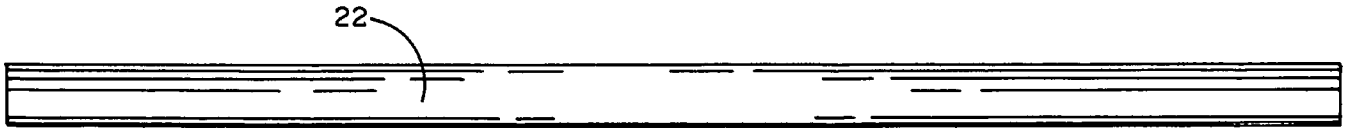
FIG. 12 is a front edge view of the vane of FIG. 9.
Figure 13:
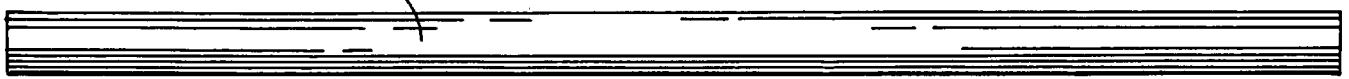
FIG. 13 is a rear edge view of the vane of FIG. 9.
Figure 14:
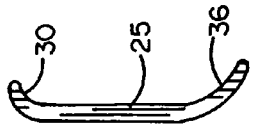
FIG. 14 is a left side view of the vane of FIG. 9.
Figure 15:
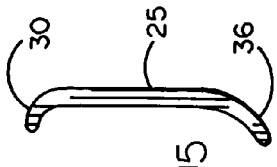
FIG. 15 is a right side view of the vane of FIG. 9.

Referring to the accompanying drawings, it will be seen that the invention hereof, according to one embodiment, comprises a set of vanes or louvers. It is actually comprised of a blind assembly 10 which has a plurality of horizontally arranged louvers, vanes or slats 12. The vanes are configured in parallel and are tiltable by a pair of control cords 14 to either permit light to pass between the vanes or be blocked by the vanes. A pull cord 21 permits raising and lowering of the louvers, vanes or slats and securing them at any position between the top and bottom of the opening. Pulling the cord completely down, would enable the louvers to totally stack and nest under the headrail. The vanes are unique in their shape as characterized by their cross-section. In one embodiment shown best in FIGS. 2-8, the vanes 12 have what is referred to herein as a symmetric cross-section. Each such symmetrical vane 12 has a planar middle section 18 and a pair of opposed fins 20 extending integrally from opposite elongated edges of the vane's middle section. Each vane 12 is curved and tapered as shown best in FIGS. 7 and 8. Each vane provides a narrow notch 23 at or near its opposed ends to receive a set of louver ladder-like control strings 35. Unlike conventional vanes, the notches are provided only in the fins 20, not in the middle section 18.

Figure 1:
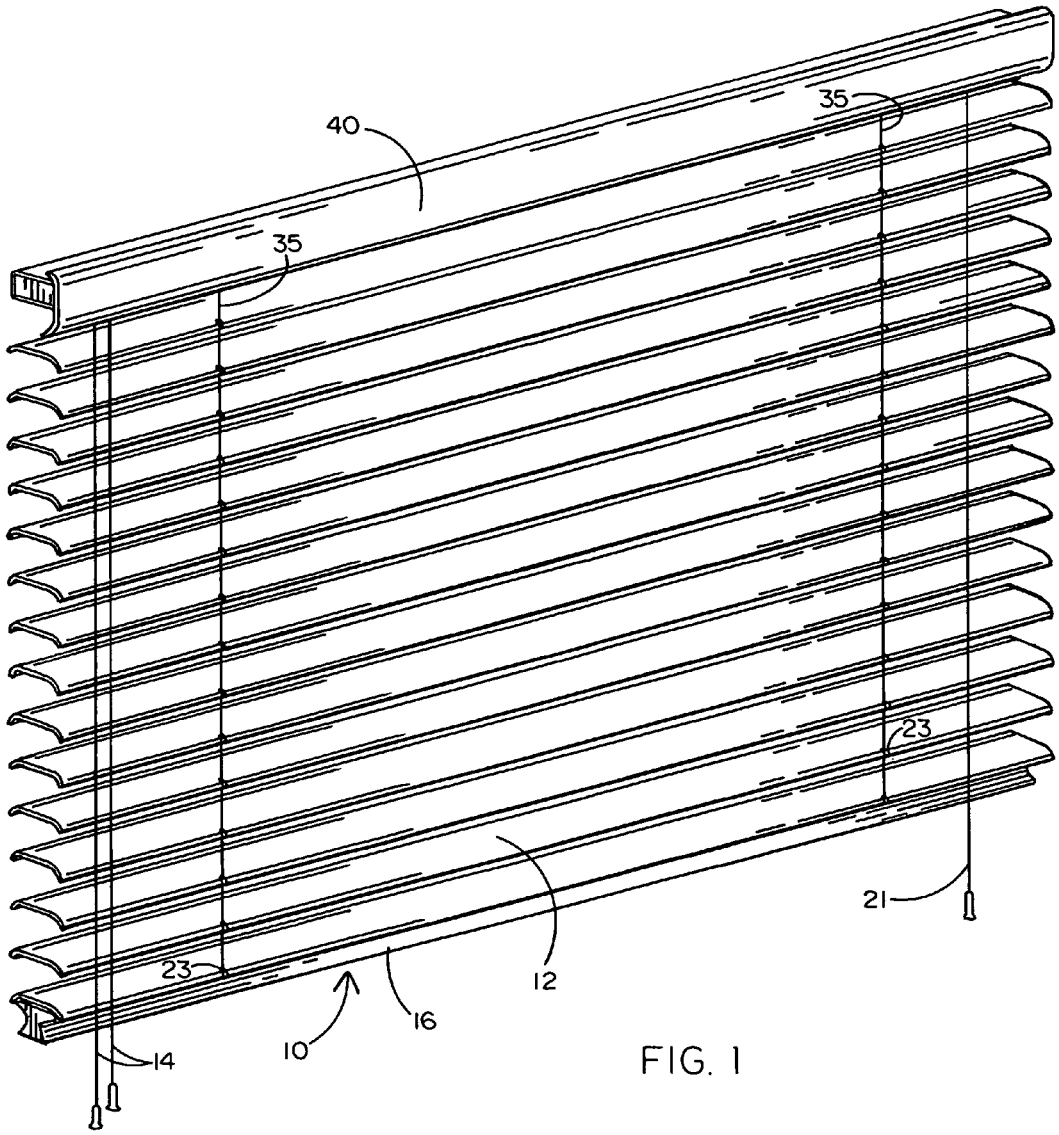
FIG. 1 is a three-dimensional view of horizontal blinds in accordance with one preferred embodiment of the present invention.
Figure 2:
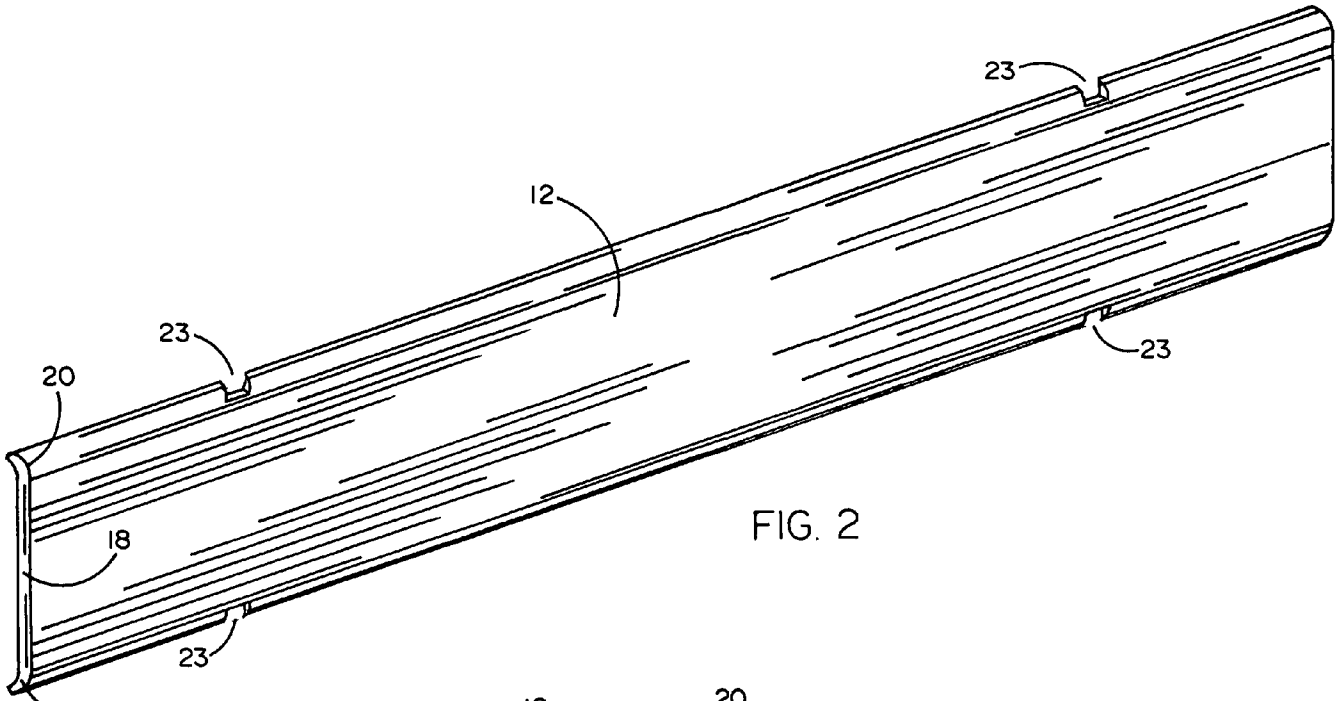
FIG. 2 is a three-dimensional view of a symmetrical version of a vane for use in the unit of blinds of FIG. 1.
Figure 3:
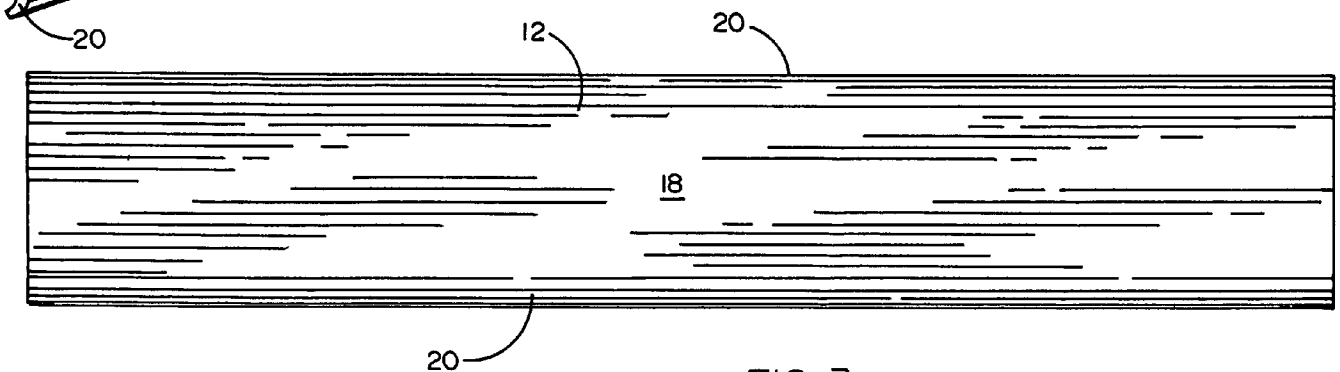
FIG. 3 is a front plan view of the vane of FIG. 2.
Figure 4:
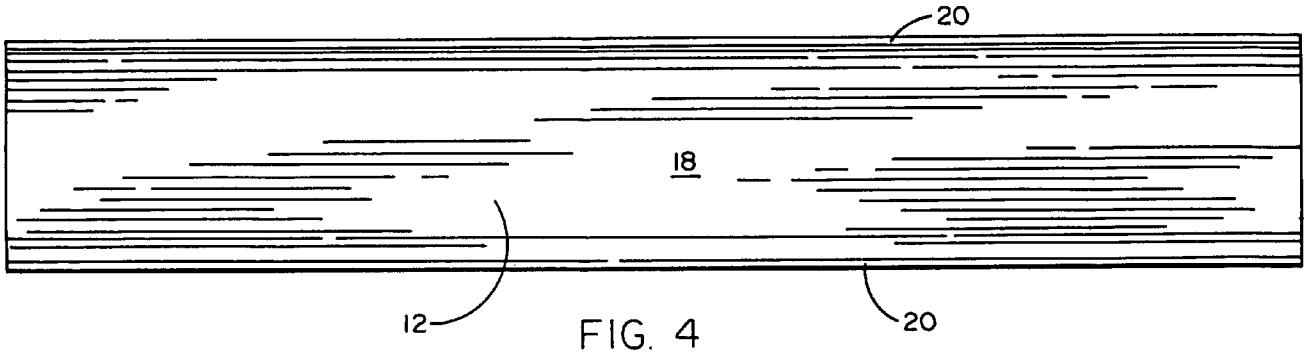
FIG. 4 is a rear plan view of the vane of FIG. 2.
Figure 5:
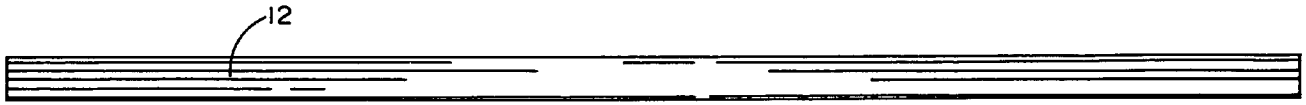
FIG. 5 is a front edge view of the vane of FIG. 2.
Figure 6:
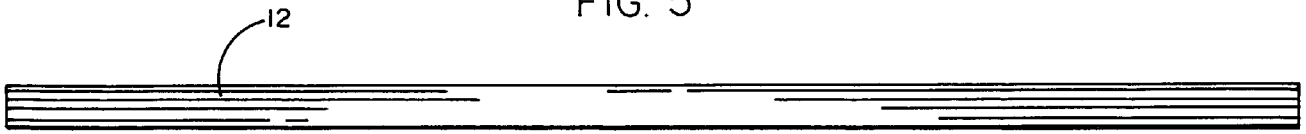
FIG. 6 is a rear edge view of the vane of FIG. 2.
Figure 18:
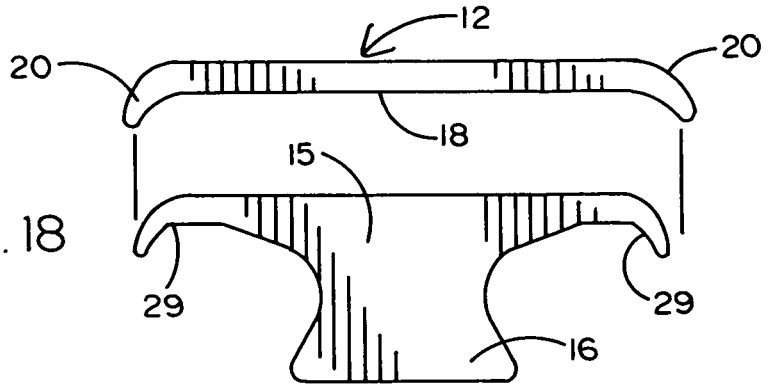
FIGS. 18 and 19 illustrate the bottom rail of the symmetrical version of a preferred embodiment and the nesting of corresponding of a corresponding vane therewith.
Figure 19:
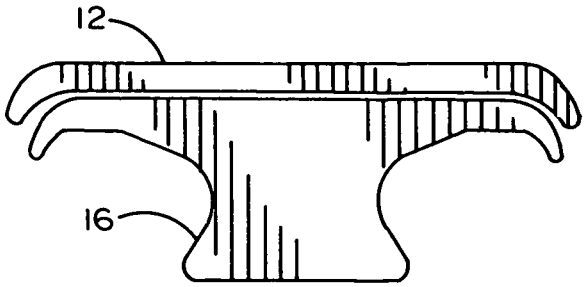

The principal advantage of such a cross-section is that the vane becomes more resistant to bending and has greater deflection properties than standard vanes so they can therefore be longer between vertical supports. In shutters, which are attached at either end of the louver without the benefit of additional vertical supports, greater deflection properties are a desired feature. Louvers orientated vertically in vertical blinds and shutters depend on the dimensional stability of the design to determine the maximum length that the louvers can be manufactured. These improved louver designs maximize these properties. However, that is not the only benefit of employing such a cross-section. Another significant advantage of the use of obtuse angled fins is the improved blockage of light entering between the tilted vanes. Still another advantage is achieved aesthetically in having a uniquely sculptured appearance resulting from the shape of the vanes. Moreover, the blinds of FIG. 1 employ a unique head-rail and bottom rail, each designed to add to the aesthetic benefit of the vanes. The bottom rail 16, shown best in FIGS. 18 and 19, is shaped to match the cross-section of the vane 12 for both improved appearance and better nesting. The head-rail 40 has a face member 42 which carries through the shape of the vane and a bracket member 44 to facilitate connection to a wall bracket (not shown).

Figure 16:
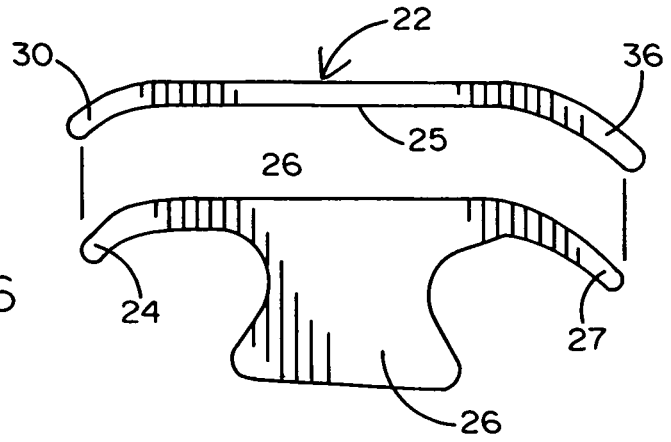
FIGS. 16 and 17 illustrate the bottom rail of the asymmetrical version of a preferred embodiment and the nesting of a corresponding vane therewith.
Figure 17:
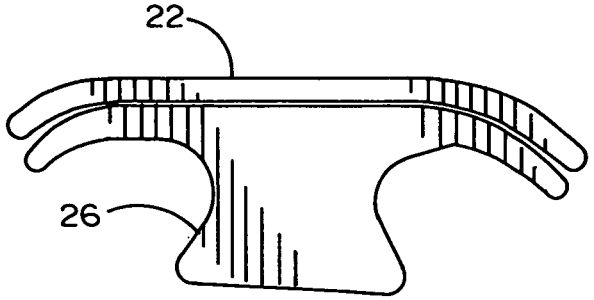

In a second embodiment, shown in FIGS. 9 to 15, the vanes or slats 22 are asymmetrical having a planar middle portion 25 and two different fins 30 and 36. Fin 30 has substantially the same shape and dimensions as the symmetrical fins 20 of the first embodiment. However, fin 36 while also being curved and tapered, has a greater length and therefore a longer taper, as well as a more gradual curve as seen best in FIGS. 14 and 15. The bottom rail 26 (see FIGS. 16 and 17) of the asymmetrical vane embodiment, has a planar middle portion 28 and fins 24 and 27, the former being shorter than the latter to comport with the unequal length fins 30 and 36 of vane 22 and thus also provides good nesting and an aesthetically pleasing uniformity.

Figure 26:
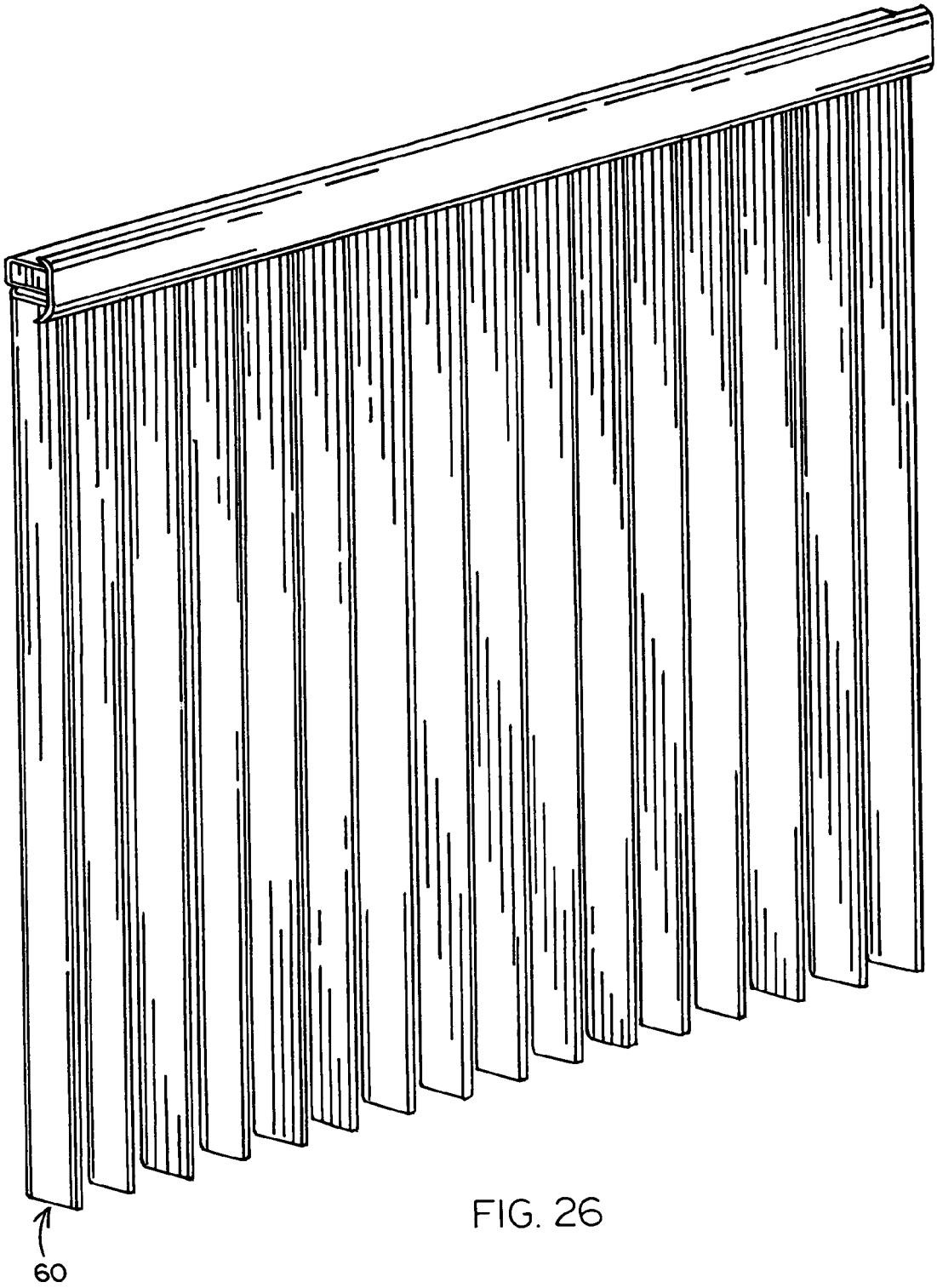
FIGS. 26 and 27 show the three-dimensional views of vertical and shutter versions of the present invention.
Figure 27:
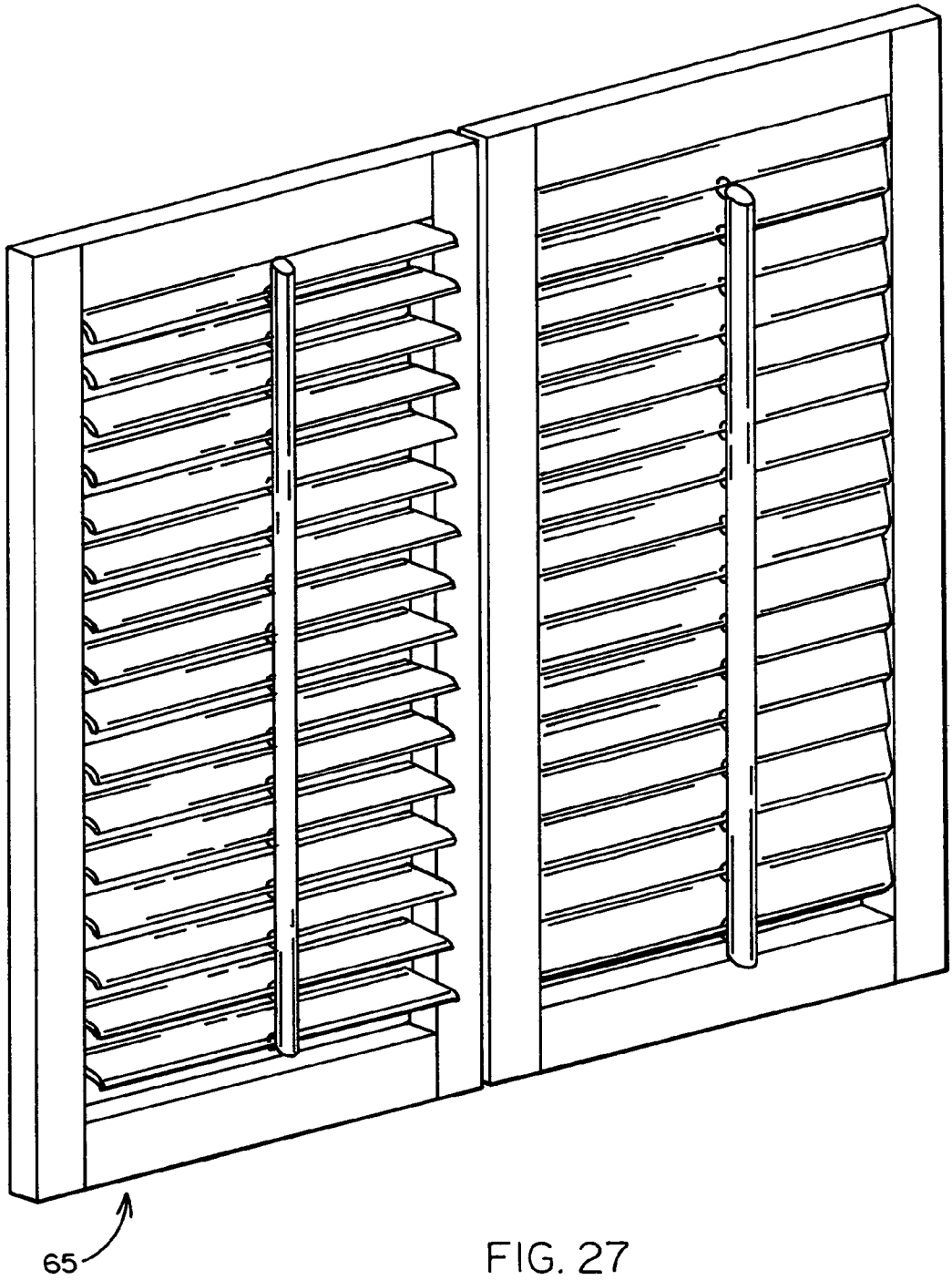

FIGS. 26 and 27 show other embodiments of the present invention, namely, vertical blinds 60 and shutters 65 using the unique louvers disclosed herein.

Figure 20:
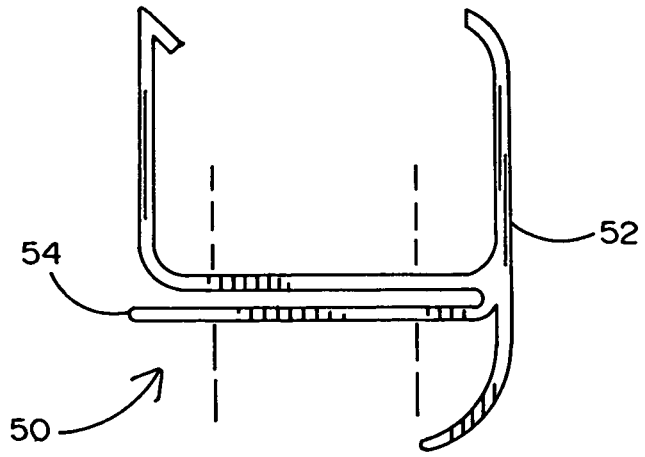
FIGS. 20 and 21 show respective edge views of a head-rail for asymmetric and symmetric vanes, respectively.
Figure 21:
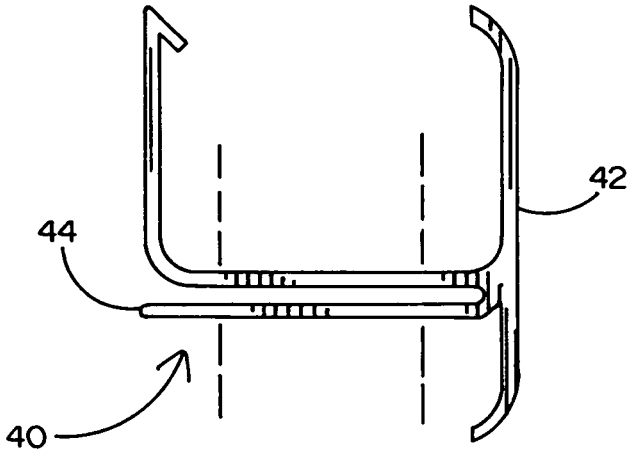
Figure 22:
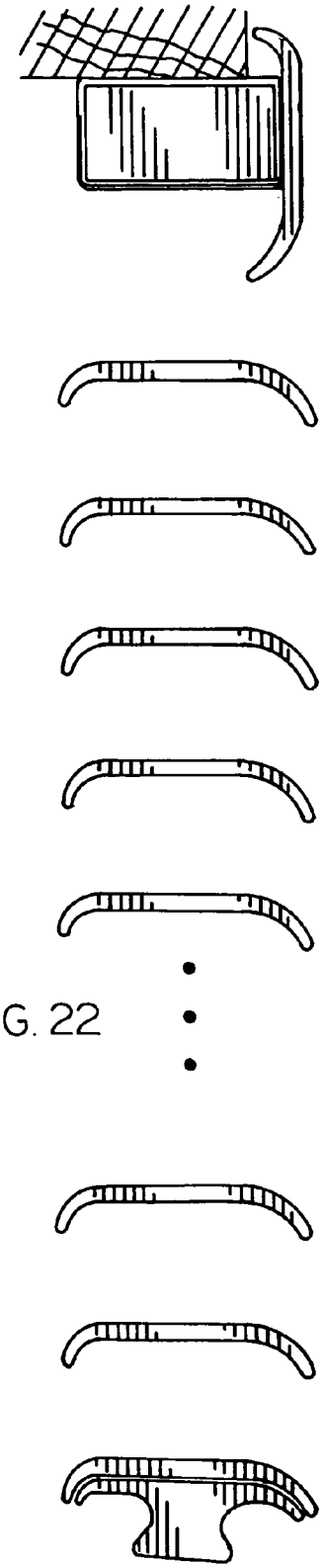
FIGS. 22 and 23 show edge view of open and substantially closed configurations of the asymmetrical vane blinds.
Figure 23:
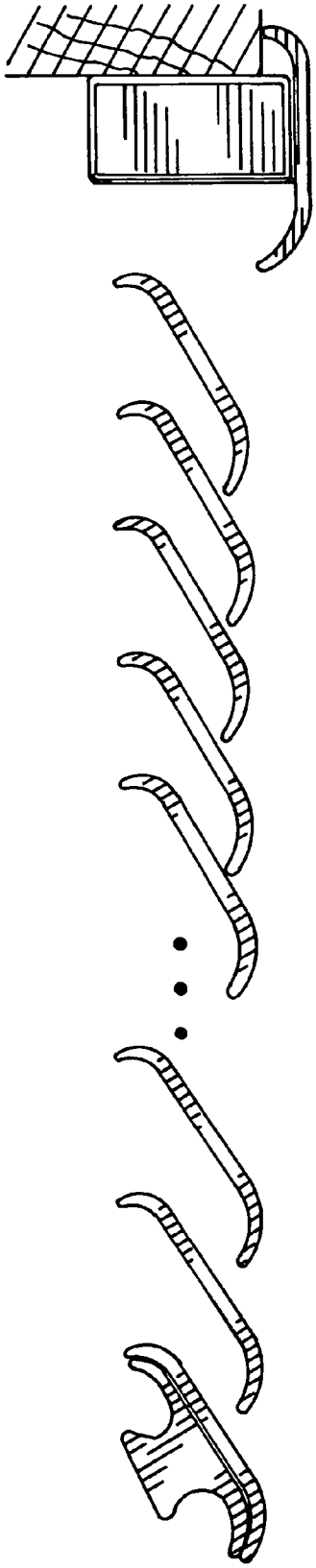
Figure 24:
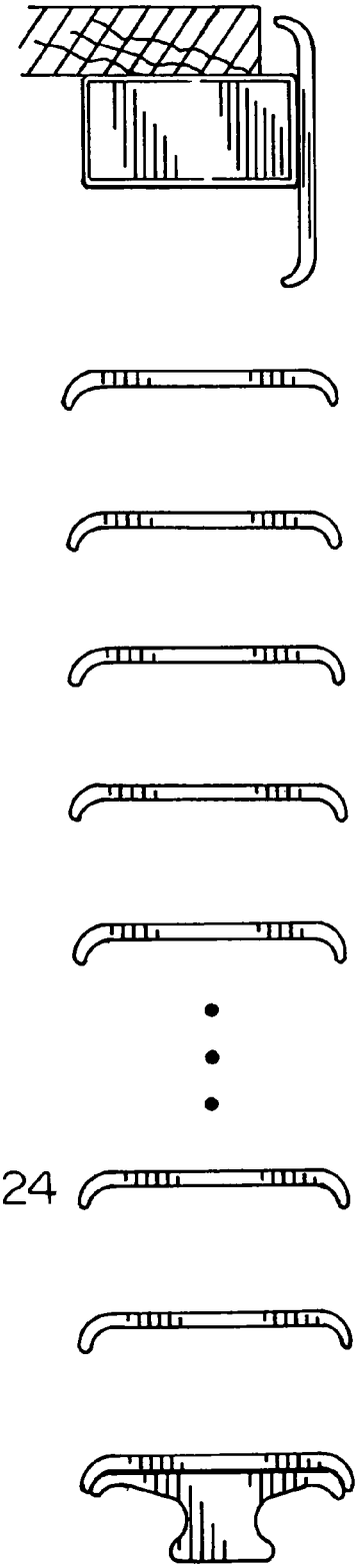
FIGS. 24 and 25 show edge views of open and substantially closed configurations of the symmetrical vane blinds.
Figure 25:
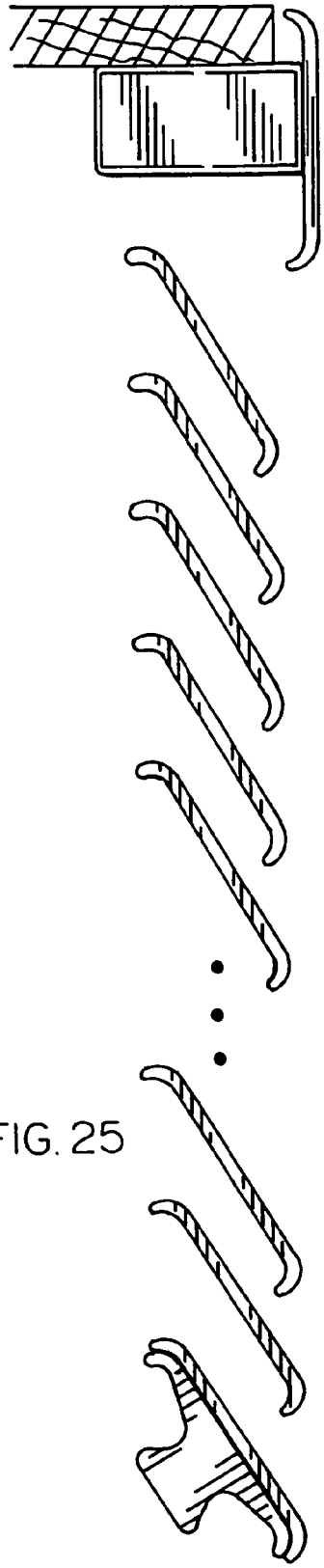

This embodiment also has a corresponding head-rail 50 (see FIG. 20) which includes an asymmetrical face 52 otherwise configured like head-rail 40 and bracket member 54 to connect the head-rail to a wall bracket (not shown).

It will now be evident from the disclosure herein, that the present invention pertains to a novel set of window-covering blinds or shutters which may be either vertically or horizontally oriented and has a set of uniquely configured louvers. Each such louver has an advantageous new cross-section comprising a planar middle portion and opposed fins extending integrally downwardly from the elongated edges of the middle portion at an obtuse angle. This unique cross-section provides greater deflection properties, and bending resistance which increases the distance permitted between vane control supports. It also provides improved light blocking for example for darkening a room interior during daylight hours. Furthermore, it has aesthetic advantages not known in conventional blinds. A compatible head-rail and bottom rail also contribute to the aesthetics of the blinds hereof.

I claim:

1. A louver for use in window blinds, and shutters, the louver having a cross-section comprising:

a planar middle section extending laterally between a pair of opposed curved fins; and said opposed fins extending outward from opposite elongated edges of said middle section, each said fin having a curvilinear contour terminating at an edge cross-sectionally tapered with respect to a longitudinal axis, and extending at an obtuse downward angle relative to said planar middle section;

said fins each extending integrally from said middle section, wherein substantially identical ones of the louver are stackable with said planar middle sections thereof being stacked in direct contact one over the other.

2. The louver of claim 1 wherein each of said fins is identical to the other to form a symmetrical cross-section.

3. The louver of claim 1 wherein each of said fins is different from the other in at least its length, to form an asymmetrical cross-section.

4. The louver of claim 1 wherein each of said fins is tapered along at least a portion of its length.

5. Window-covering blinds having simultaneously tiltable vanes disposed between a head-rail and a bottom rail; the blinds comprising:

a plurality of said tiltable vanes configured in parallel arrangement and spaced to selectively provide either transmission of light between said vanes or substantial blockage of light therebetween depending on the angle of tilt of said vanes;

said head-rail having at least one visible member having a cross-section substantially identical to each said vane;

said bottom rail having at least one member shaped for nesting engagement with said vanes;

each vane having a cross-section formed by a planar middle section extending laterally between a pair of opposed curved tapered fins extending outward from opposite elongated edges of said middle section, each said fin having a curvilinear contour terminating at an edge cross-sectionally tapered with respect to a longitudinal axis, and extending at an obtuse angle relative to said middle section and extending integrally therefrom, wherein said vanes are stackable with said planar middle sections thereof being stacked in direct contact one over the other.

6. The blinds of claim 5 wherein each of said fins is identical to the other to form a symmetrical cross-section.

7. The blinds of claim 5 wherein each of said fins is different from the other in at least its length, to form an asymmetrical cross-section.

8. A window-covering apparatus comprising a plurality of parallel louvers configured for being simultaneously tilted to selectively interrupt and pass light entering the window, each said louver having a cross-section providing a planar middle section extending laterally between a pair of opposed curved fins, each said fin having a curvilinear contour terminating at an edge cross-sectionally tapered with respect to a longitudinal axis, and extending at an obtuse angle from said middle section to increase the deflection properties of said louver and increase the light blocking aspect of said plurality of louvers when tilted to interrupt light, wherein said louver are stackable with said planar middle sections thereof being stacked in direct contact one over the other.

9. The window covering apparatus of claim 8 further comprising a head-rail having a face that has substantially the same cross-section as said louvers.

10. The window covering apparatus of claim 8 further comprising a bottom rail having a nesting surface shaped to conform to the cross-section of said louvers.

11. The window covering apparatus of claim 8 wherein said opposed fins are of substantially the same size and shape.

12. The window covering apparatus of claim 8 wherein said opposed fins are of different size.

13. The window covering apparatus of claim 8 wherein said opposed fins are of different shape.

14. The window covering apparatus of claim 8 wherein said opposed fins are tapered.

15. The window covering apparatus of claim 8 wherein said opposed fins extend integrally from opposite elongated edges of said planar middle section.

16. The window covering apparatus of claim 8 wherein said louvers are substantially horizontal.

17. The window covering apparatus of claim 8 wherein said louvers are substantially vertical.

18. The window covering apparatus of claim 8 wherein said louvers are interconnected to form blinds.

19. The window covering apparatus of claim 8 wherein said louvers are interconnected to form shutters.

20. The window covering apparatus of claim 8 wherein each of said louvers has notches along its respective fins for receiving ladder-like members supporting said louvers in a tiltable orientation.

* * * * *